US005458035A

United States Patent [19]

Okamura

[11] Patent Number: 5,458,035

[45] Date of Patent: Oct. 17, 1995

[54] ADJUSTING MECHANISM FOR NECK ALIGNER IN STRINGED INSTRUMENT

[75] Inventor: Masaki Okamura, Saitamaken, Japan

[73] Assignee: Gotoh Gut Yugen Kaisha, Gunmaken, Japan

[21] Appl. No.: 331,949

[22] Filed: Oct. 31, 1994

[30] Foreign Application Priority Data

Nov. 10, 1993 [JP] Japan ..... 5-315747

[51] Int. Cl.[6] ..... G10D 3/00

[52] U.S. Cl. ..... 84/293

[58] Field of Search ..... 84/293, 267, 268, 84/269, 274

[56] References Cited

U.S. PATENT DOCUMENTS 4,557,174 12/1985 Gessett, Jr. ..... 84/293

FOREIGN PATENT DOCUMENTS 54-94220 7/1979 Japan .
58-38192 3/1983 Japan .
1-213697 8/1989 Japan .
1-234898 9/1989 Japan .
1-231098 9/1989 Japan .
3-20392 2/1991 Japan .
3-33488 4/1991 Japan .

*Primary Examiner*—Steven L. Stephan
*Assistant Examiner*—Cassandra C. Spyrou
*Attorney, Agent, or Firm*—Wenderoth, Lind & Ponack

[57] ABSTRACT

An adjusting mechanism for a neck aligner in a stringed instrument includes a front block and a rear block arranged in parallel in an internal chamber in a neck. A threaded engaging block and a depressing block are provided between the pair of front and rear blocks. An end of a truss rod is inserted through the pair of front and rear blocks, and a threaded part thereof is threaded into a threaded tube at a rear side of the rear block. An adjust screw is inserted through the depressing block and is threaded into the threaded engaging block. Both opposite ends of the rear block and rear end surfaces of the depressing block and the threaded engaging block in contact therewith are formed as sloped surfaces. The threaded engaging block and the depressing block are caused to approach each other by operating the adjust screw, whereby the rear block is guided on the sloped surfaces to move away from the front block and the length of the truss rod in an elongated groove is reduced.

5 Claims, 4 Drawing Sheets

ADJUSTING MECHANISM FOR NECK ALIGNER IN STRINGED INSTRUMENT

BACKGROUND OF THE INVENTION

The present invention relates to an adjusting mechanism for a neck aligner for use in a stringed instrument.

As is known, a neck of a stringed instrument inevitably is deformed by ordinary warpage due to tension of strings extended over the stringed instrument in a mode that a head part of the neck is drawn toward the side of a bridge device.

Therefore, an aligner is provided in the neck of the stringed instrument to straighten the neck to compensate for such ordinary bending deformation. This aligner has a resilient rod member having a high degree of rigidity. Such rod member is inserted into the neck as a truss rod and is adapted to apply a straightening force to the instrument in a direction opposite to the direction of ordinary bending of the neck by reducing the length of the truss rod when ordinary bending of the neck occurs.

The aligner as described above employs two rod members, as disclosed in Japanese Patent Application Disclosure Gazette (TOKUKAI) Nos. HEI. 1-231098 and HEI. 1-234898, or one rod member, as disclosed in Japanese Patent Application Disclosure Gazette (TOKUKAI) No. HEI. 1-213697 and Japanese Utility Model Application Disclosure Gazette (JITSUKAI) No. HEI. 3-33488.

The above-described aligner is provided in the neck with an adjusting mechanism for reducing the length of the truss rod inserted into the neck. The adjusting mechanism can be externally operated and is arranged in a hollow space formed in a head part of the neck, as disclosed in the above Japanese Patent Application Disclosure Gazette No. HEI. 1-234898 and Japanese Utility Model Application Disclosure Gazette No. HEI. 3-33488, or arranged at a body side coupling portion of the neck, as disclosed in Japanese Utility Model Application Disclosure Gazette No. SHO. 58-38192. Adjustment is achieved with such adjusting mechanisms by directly inserting an adjusting tool to the end of the truss rod through the hollow space of the head part of the neck or the internal hollow space of the body.

However, there are various types of stringed instruments in which an internal hollow space cannot be formed in the body, or the head is not provided with a hollow space for the appearance of the neck as a fender type guitar. In the case of these types of stringed instruments, the length of the truss rod cannot be adjusted while the neck is attached to the body.

Stringed instruments for which the truss rod is adjusted by inserting a wrench through a hollow space of the head part of the neck or a hollow space formed in the body are disadvantageous in that handling of the wrench is limited by the extended strings. Therefore, adjusting operations are difficult since adjustment must be carried out by inserting the wrench through tuned strings.

Therefore, an adjusting mechanism which makes it possible to adjust the length of the truss rod in the neck from the side of the neck has been proposed. Such mechanism is adapted so that a worm gear mechanism is coupled to an end part of the truss rod to actuate the truss rod, as disclosed in Japanese Utility Model Application Disclosure Gazette Nos. SHO. 54-94220 and HEI. 3-20392. The adjusting mechanism using the above worm gear mechanism is constructed so that a threaded part formed at the-end of the truss rod is meshed with a worm wheel. The worm is rotated by an external operation, while the worm wheel is kept meshed with the worm to move the threaded part of the truss rod forwardly and backwardly in an axial direction, thereby changing the length of the truss rod.

As regards the adjusting mechanism which employs such worm mechanism as described above, there is a problem that it is necessary to reduce the pitch of the worm wheel to accurately adjust the length of the truss rod. However, if the pitch of the worm wheel is made small, the adjusting mechanism cannot withstand a resilient force to be applied during adjustment of the length of the truss rod and is not applicable to practical use. Moreover, external operation of the worm wheel cannot be carried out lightly and smoothly, since the worm wheel is internally meshed with the end part of the truss rod, and adjustment of the length of the truss rod is doubly decelerated by the internal and external threads of the worm wheel.

SUMMARY OF THE INVENTION

An object of the present invention is to provide an adjusting mechanism capable of adjusting the length of a truss rod along a neck by means of an adjust screw which can be directly operated from the outside, thereby solving the problems of the prior art worm gear mechanism.

The present invention is intended to provide an adjusting mechanism which is constructed so that a front block and a rear block, opposed to each other in the axial direction of the neck, are arranged opposed to each other in an internal chamber formed in a base of the neck. A depressing block and a threaded engaging block are arranged between right ends and left ends of such front and rear blocks. An adjust screw is inserted through a hole into the internal chamber from the side of the neck. The adjust screw is inserted into the depressing and engaging blocks and is formed to be externally operated.

Through holes are formed in respective central portions of the front block and the rear block. An end of the truss rod is formed as a threaded portion and protrudes behind the rear block. The adjust screw is passed through a through hole provided in the depressing block and is meshed into a threaded hole in the threaded engaging block. A depressing pipe having therethrough an aperture larger than the through hole of the depressing block is provided as a depressing means between the depressing block and a head of the adjust screw. Sloped surfaces which are inclined rearwardly are formed with the same angle of inclination at both opposite ends of the rear block. A sloped surface formed on a rear end of the depressing block and a sloped surface formed on the rear end of the threaded engaging block closely contact the sloped surfaces of the rear block. A rear surface of the front block is formed as a smooth planar surface, and a front end surface of the depressing block and a front end surface of the threaded engaging block are formed as smooth planar surfaces.

The adjusting mechanism according to the present invention is as described above. When a tool turns the adjust screw to advance the threaded part of the adjust screw more deeply into the threaded engaging block, the threaded engaging block and the depressing block move in directions toward each other, and rear end surfaces of both such blocks push the sloped surfaces of the rear block. Therefore, the rear end of the truss rod which is engaged with the rear block is drawn out from an elongated groove and the length of the truss rod in the elongated groove is reduced to increase a resilient force thereof, that is a straightening force. The amount of reduction of length of the truss rod in the elongated groove is determined from the pitch of the threaded part of the adjust screw and the angle of inclination of the sloped surfaces of the rear block.

DETAILED DESCRIPTION OF THE INVENTION

Figure 1:
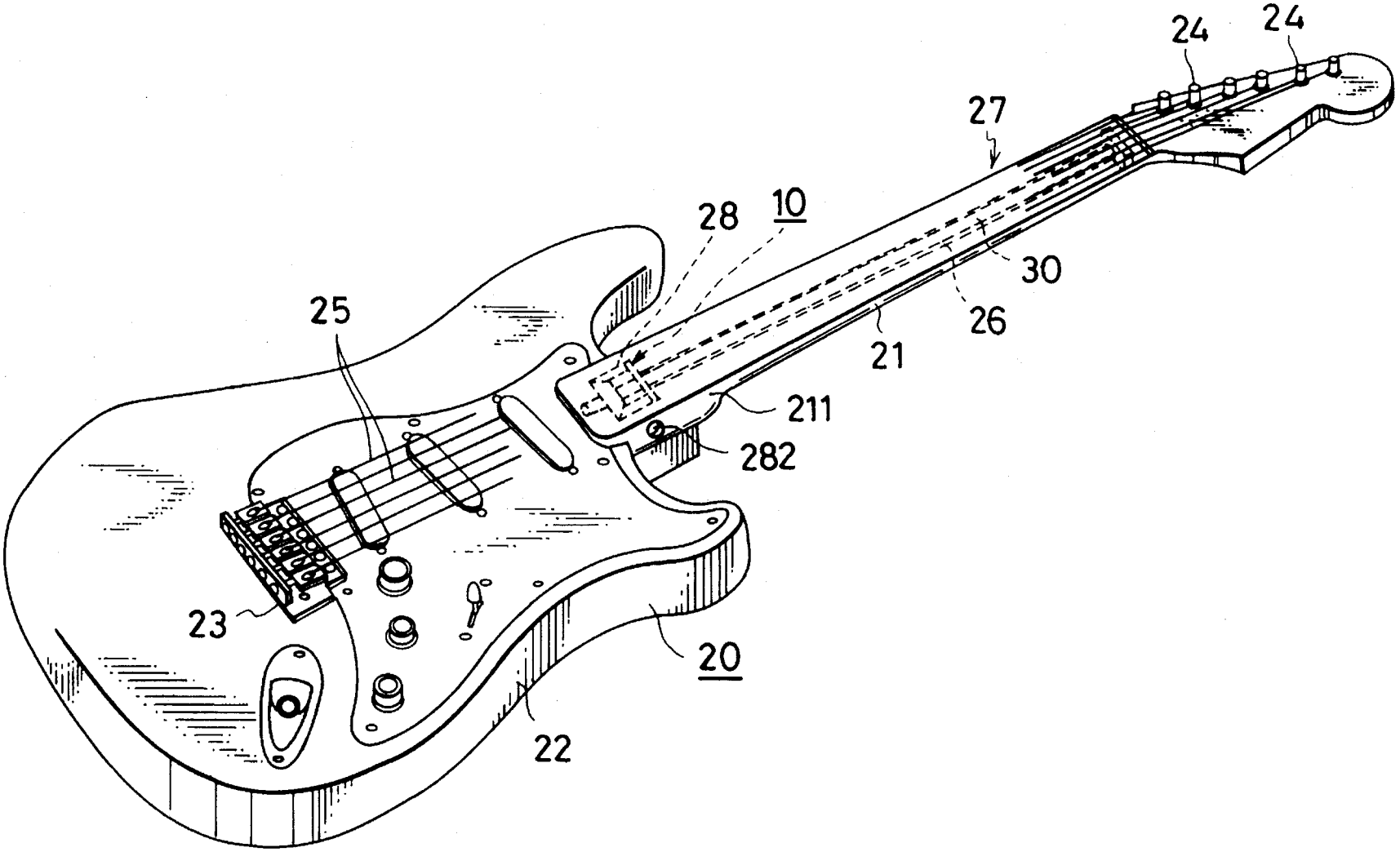
FIG. 1 is a perspective view of a guitar provided with an adjust mechanism according to the present invention.
Figure 2:
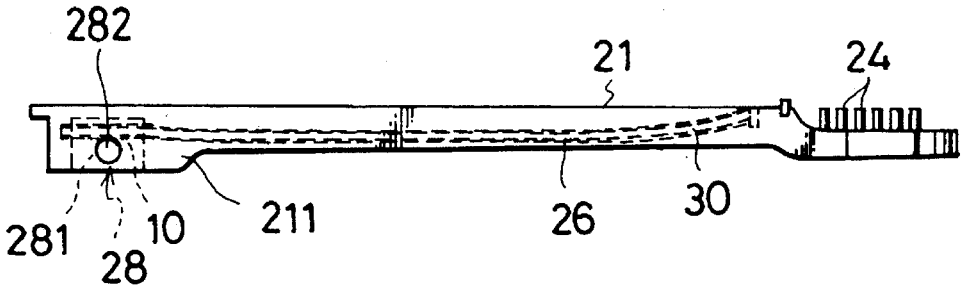
FIG. 2 is a side view of the neck of the guitar.

FIG. 1 shows a guitar 20 provided with an adjust mechanism 10 according to the present invention and with a truss rod 30 accommodated in a neck 21 of the guitar. A bridge 23 is provided on body 22 of the guitar 20 and a required number of pegs 24 are mounted on the neck 21. Strings 25 are extended between bridge 23 and pegs 24. The truss rod 30 is accommodated in an elongated groove 26 provided in the neck 21, and the elongated groove 26 is closed by a finger board 27. One end of the truss rod 30 is fixed in the elongated groove 26 and the other end is made as a threaded part 31.

An internal chamber 28 for accommodating the adjust mechanism 10 is formed at base 211 of the neck 21, that is, an end of the neck 21 connected to the body 22. A window 281 is formed in neck 21 and is open from chamber 28 downwardly of the neck 21, that is, the side thereof opposite to the surface where the strings 25 are extended. A through hole 282 is formed through neck 21 and is open at a later side thereof.

Figure 3:
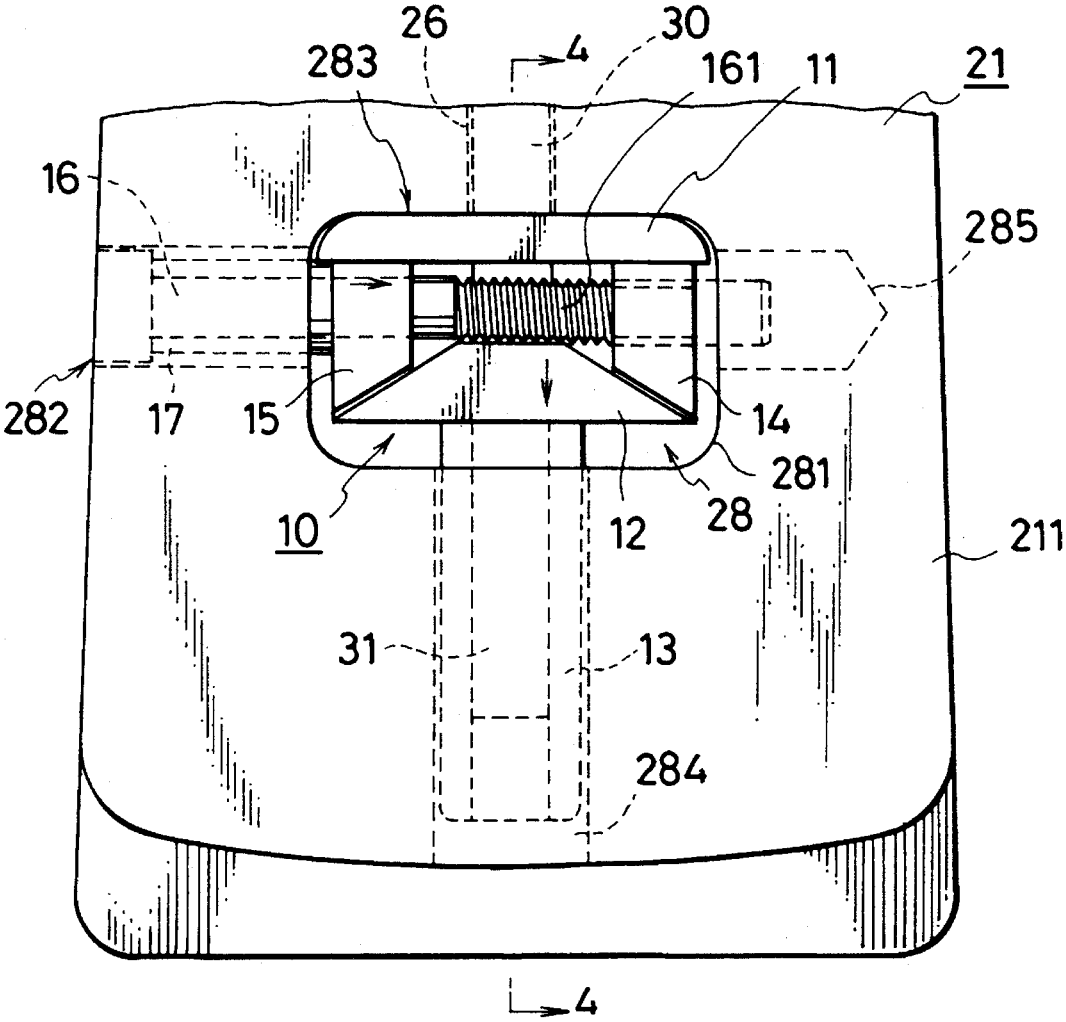
FIG. 3 is an enlarged bottom view of part of the neck of the guitar.
Figure 4:
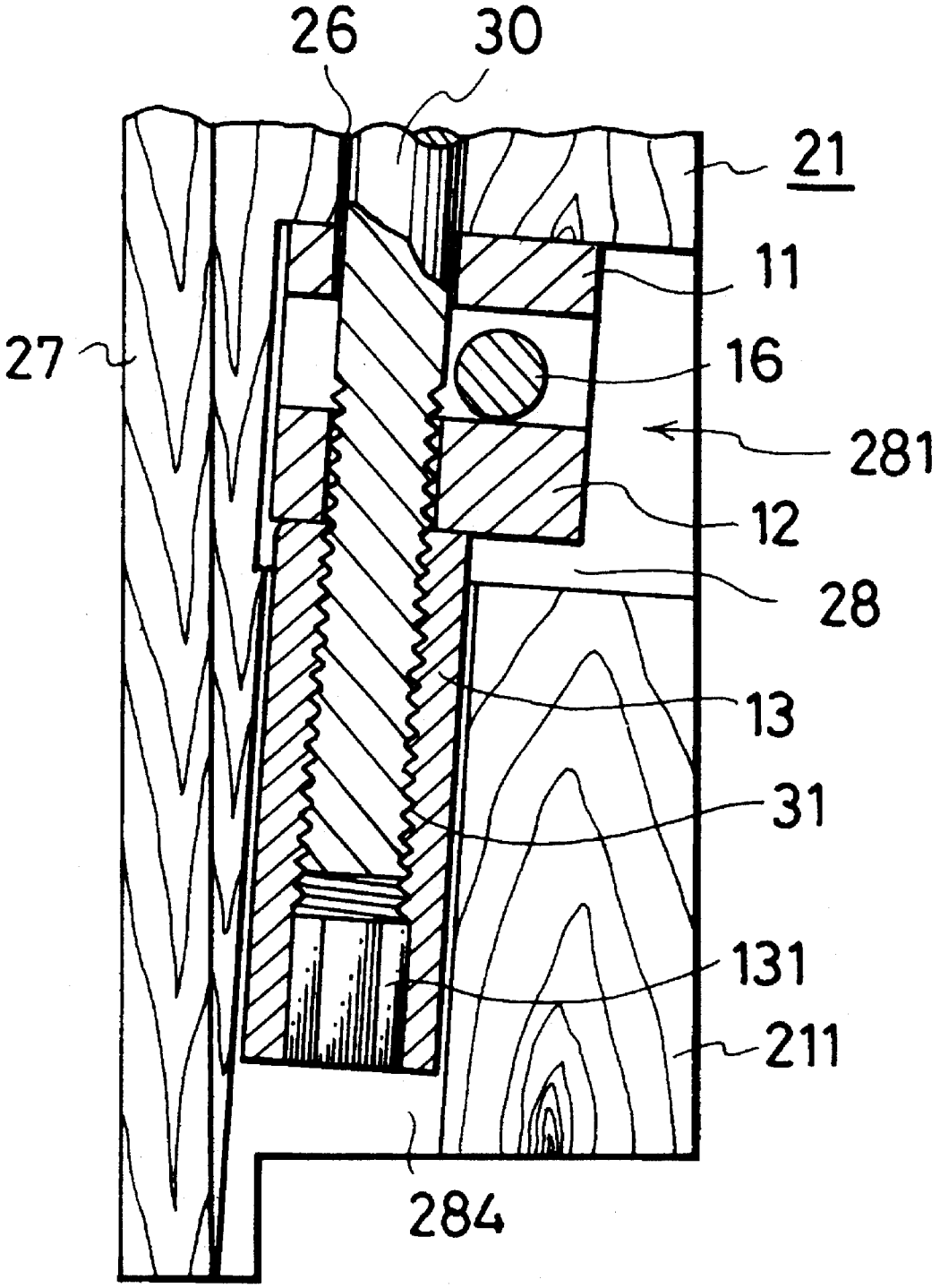
FIG. 4 is a sectional view along line 4—4 in FIG. 3.
Figure 5:
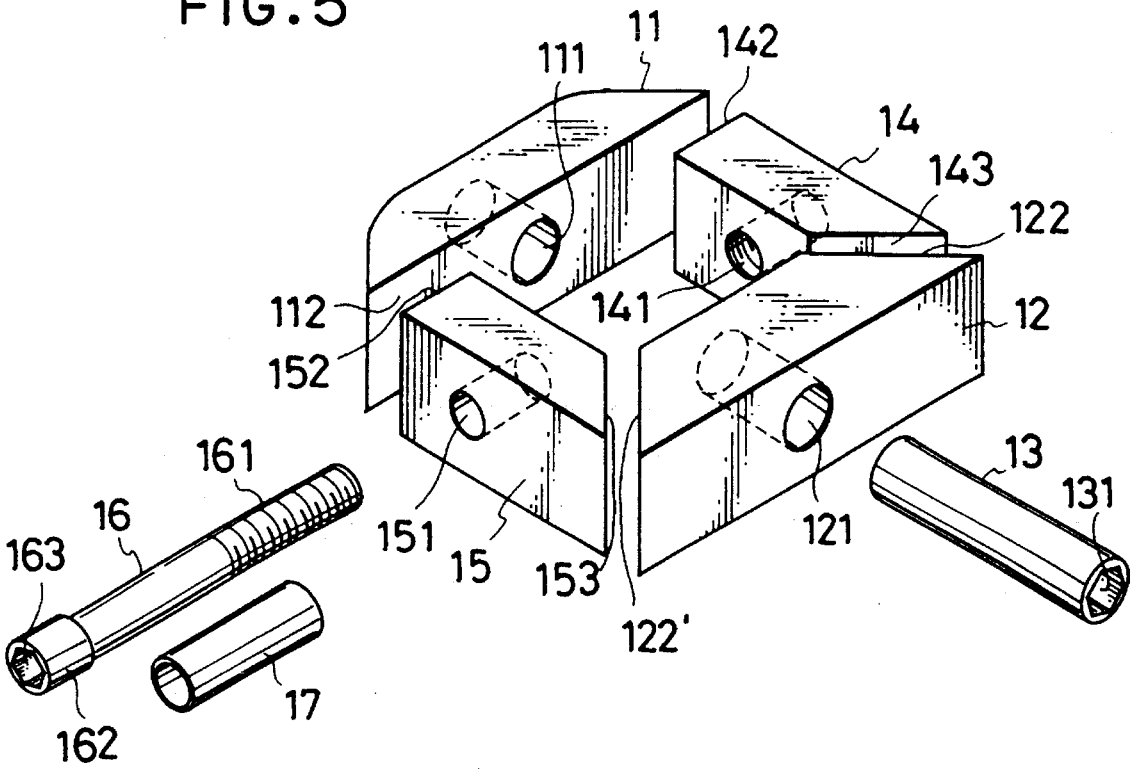
FIG. 5 is an exploded perspective view of the adjust mechanism according to the present invention.

The adjust mechanism 10, as shown in FIGS. 3 to 5, includes a front block 11 through which an end part of truss rod 30 is inserted and which contacts a front wall 283 of internal chamber 28. A rear block 12 is opposed to the front block 11, and the end of the truss rod 30 is inserted therein. A threaded cylinder 13 meshes with the end threaded part 31 of the end of truss rod 30, while being kept in contact with the rear surface of the rear block 12, and is provided with a receiving part 131 which accepts, for example, a hexagonal wrench to be externally actuated. A threaded engaging block 14 and a depressing block 15 are provided at right and left opposite lateral positions opposing each other and between the front block 11 and the rear block 12. An adjust screw 16 extends through depressing block 15 and meshes with threads of threaded opening 141 in block 14. A depressing pipe 17, forming a depressing means, is fitted externally to the adjust screw 16. The depressing means can be formed so that the depressing pipe 17 is integrated with the adjust screw 16, and a flange type depressing piece can be formed on the adjust screw 16.

The front block 11 has a through hole 111, provided at a central portion thereof and through which the truss rod 30 is inserted, and a rear surface 112 confronting the rear block 12 and formed as a smooth planar surface. The rear block 12 is provided with a through hole 121 into which the threaded part 31 of the truss rod 30 is loosely inserted. Block 12 has at a portion thereof confronting the front block 11 inclined or sloped surfaces 122 and 122' that are inclined rearwardly and outwardly at the same angle of inclination.

The threaded engaging block 14 is provided at a central portion thereof with threaded hole 141 into which threaded part 161 of the adjust screw 16, extending orthogonally transverse to the truss rod 30, is meshed. Block 14 has a smooth, planar front end surface 142 contacting the front block 11 and an inclined rear end surface 143 in close contact with the sloped surface 122 of the rear block 12.

The depressing block 15 is provided at a central portion thereof with through hole 151 into which the adjust screw 16 is inserted. Block 15 has a smooth, planar front end surface 152 contacting the front block 11 and an inclined rear end surface 153 in close contact with the sloped surface 122' of the rear block 12.

The adjust screw 16, as described above, has a threaded front portion 161 which is meshed with the threads of hole 141 of block 14. Screw 16 is inserted through through hole 282 at the side of the internal chamber 28. Thus, a shank portion of the adjust screw 16 is inserted into the through hole 151 of the depressing block 15. A coupling means is provided at a head part 162 of an outer or rear end of screw 16, such as, for example, a wrench hole 163 for accepting a hexagonal wrench which can be operated from the exterior. The depressing block 15 is constructed so as to be depressed inwardly or moved toward the thread-engaging block 14 by depressing means provided on the adjust screw 16. In this embodiment, depressing pipe 17 having a larger aperture than the through hole 151 of the depressing block 15 is provided between the head part 162 of the adjust screw 16 and the depressing block 15.

An accommodating hole 284 for accommodating the threaded cylinder 13 is connected to the internal chamber 28 within the neck 21. Accommodating hole 284 passes through base 211 of the neck 21 in the axial direction of the neck 21 and has a degree of curve sufficient to extend along a curve of the truss rod 30. A recessed hole 285 which is aligned with the through hole 141 of the thread-engaging block 14 is provided in that internal side wall of the internal chamber 28 that confronts the block 14, as shown in FIG. 3, and the end part of the threaded portion 161 of the adjust screw 16 which protrudes from the block 14 is accommodated in recessed hole 285.

The adjust mechanism 10 according to the present invention is as described above. Therefore, after assembling the neck 21 with the body 22, the adjust screw 16 is turned to set the block 14 and the block 15 so that such two blocks are positioned at an intermediate position of respective distances of movement. Secondly, the threaded cylinder 13 is rotated by driving the receiving part 131 thereof with a tool such as a wrench to reduce the length of the truss rod 30 in the elongated groove 26 so as to correct for expected ordinary warpage of the neck. At this stage, the neck 21 is slightly reversely warped in a direction opposite to the direction of expected ordinary warpage of the neck 21, and the threaded cylinder 13 is forced to contact the rear block 12 by a repulsive force of the neck 21. Thus, the neck 21 which is slightly reversely warped is assembled with the body 22, and strings 25 are extended on the instrument body and tuned.

Figure 6:
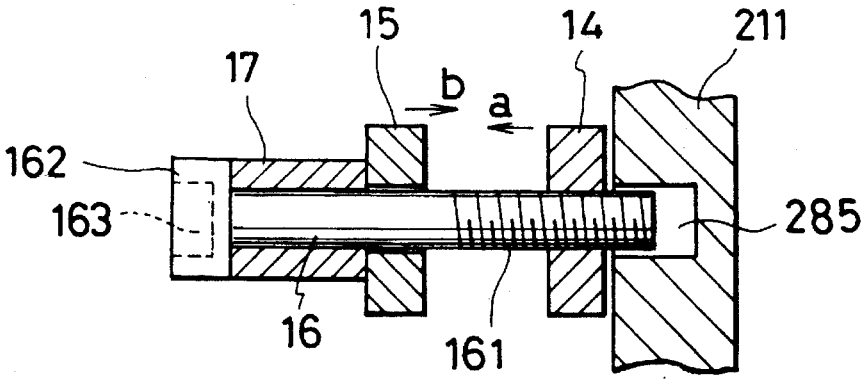
FIG. 6 is a section illustrating the function of the adjust mechanism.

If neck 21 is ordinary warped, the adjust screw 16 is turned forwardly by a wrench. If neck 21 is reversely warped, the adjust screw 16 is turned reversely to adjust the warpage of the neck. If the adjust screw 16 is turned forwardly as described above, the block 14 is pulled in the direction of arrow a in FIG. 6 by the adjust screw 16, and the depressing block 15 is pushed in the direction of arrow h by the depressing pipe 17. Therefore, the rear block 12 is pushed out in a direction to move away from the front block 11, and the length of the truss rod 30 in the elongated groove 26 is reduced, whereby a resilient force of the truss rod 30 is increased. Accordingly, ordinary warpage of the neck 21 in the reverse direction is increased.

The adjust mechanism according to the present invention can be employed in a neck aligner of a construction in which another rod member is assembled in parallel in addition to the truss rod 30. In such case, the other rod member to be arranged opposing to the truss rod 30 can be arranged so that one end of the rod member is coupled to the end of the truss rod 30 and the other end thereof is fixed in the elongated groove 26, similar to the prior art device.

The adjust mechanism according to the present invention is adapted to adjust the block 15 and the block 14 to approach each other and move away from one another by operating the adjust screw 16 with external operating means, thereby moving the rear block 12 in the axial direction of the neck 21. Therefore, the amount of movement of the rear block 12, that is the length of the truss rod 30 in the elongated groove 26, can be finely adjusted by reducing the pitch of the threaded part 161 of the adjust screw 16 and, because the amount of movement of the rear block 12 can be determined by the inclined surfaces 122 and 122', fine adjustment of such amount of movement can be enabled by selecting the angle of inclination of such inclined surfaces.

The present invention is intended to adjust the length of the truss rod 30 by directly turning the adjust screw 16, and therefore provides an effect to facilitate the adjustment operation without possibility of a deceleration function, differing from the prior art worm gear arrangement. Consequently, the adjust mechanism according to the present invention also provides an effect to accurately correct warpage of the neck 21, even after the neck 21 has been assembled with the body 22.

What is claimed is:

1. An adjusting mechanism for a neck aligner in a stringed instrument, said adjusting mechanism comprising:

a front block to be positioned in an internal chamber formed in a base of a neck of the stringed instrument so that said front block will orthogonally intersect an axis of the neck with a front surface of said front block to be abutted with a front wall of the internal chamber, said front block having at a center portion thereof, a through hole through which is to pass loosely a truss rod of the neck, said front block having a planar rear surface;

a rear block to be positioned in the internal chamber and extending parallel to said front block, said rear block having at a center portion thereof a through hole through which an end part of the truss rod is to pass, said rear block having opposite ends defined by sloped surfaces opposing said front block and inclined outwardly and rearwardly at the same angle of inclination;

a threaded cylinder to be threaded to a threaded end portion of the truss rod and in abutment with a rear surface of said rear block;

a depressing block and an engaging block extending parallel to each other and positioned between respective ends of said front and rear blocks, said depressing block having at a center thereof a through hole and having an inclined rear surface in contact with a respective said sloped surface of said rear block, and said engaging block having at a center thereof a threaded hole and having an inclined rear surface in contact with a respective said sloped surface of said rear block;

an adjust screw loosely passed through said through hole of said depressing block and having a threaded end part meshing with threads of said threaded hole of said engaging block; and depressing means for depressing said depressing block toward said engaging block against a resilient force of the truss rod as said threaded end part of said adjust screw is threaded further deeper into said threaded hole of said engaging block;

wherein said rear block is moved in an axial direction of the neck along said inclined surfaces of said depressing and engaging blocks by turning said adjust screw to move said depressing block and said engaging block in directions toward and away from each other.

2. An adjusting mechanism as claimed in claim 1, wherein said depressing means comprises a pipe positioned between a head of said adjust screw and said depressing block, said pipe having therethrough an aperture through which extends said adjust screw and that is larger than said through hole of said depressing block.

3. A neck of a stringed instrument having a neck aligner including a truss rod in an elongated groove in said neck, and a mechanism for adjusting said neck aligner, said adjusting mechanism comprising:

a front block positioned in an internal chamber formed in a back of said neck so that said front block orthogonally intersects an axis of said neck, said front block having a front surface abutting a front wall of said internal chamber, said front block having at a center thereof a through hole through which passes loosely said truss rod, and said front block having a planar rear surface;

a rear block positioned in said internal chamber and extending parallel to said front block, said rear block having at a center portion thereof a through hole through which passes an end part of said truss rod, said rear block having opposite ends defined by sloped surfaces opposing said front block and inclined outwardly and rearwardly at the same angle of inclination;

a threaded cylinder threaded to a threaded end portion of said truss rod and in abutment with a rear surface of said rear block;

a depressing block and an engaging block extending parallel to each other and positioned between respective ends of said front and rear blocks, said depressing block having at a center thereof a through hole and having an inclined rear surface in contact with a respective said sloped surface of said rear block, and said engaging block having at a center thereof a threaded hole and having an inclined rear surface in contact with a respective said sloped surface of said rear block;

an adjust screw inserted through said neck into said internal chamber and extending orthogonally transversely of said truss rod, said adjust screw loosely passing through said through hole of said depressing block and having a threaded end part meshing with threads of said threaded hole of said engaging block;

depressing means for depressing said depressing block toward said engaging block against a resilient force of said truss rod as said threaded end part of said adjust screw is threaded further deeper into said threaded hole of said engaging block;

wherein said rear block is moved in an axial direction of said neck along said inclined surfaces of said depressing and engaging blocks by turning said adjust screw to move said depressing block and said engaging block in directions toward and away from each other, whereby a length of said truss rod in said elongated groove in said neck is adjusted.

4. An adjusting mechanism for said neck aligner as claimed in claim 3, further comprising a through hole formed in a side of said base of said neck base and extending into said internal chamber, said adjust screw extending into said internal chamber through said through hole.

5. An adjusting mechanism for said neck aligner as claimed in claim 3, wherein said depressing means comprises a pipe positioned between a head of said adjust screw and said depressing block, said pipe having therethrough an aperture through which extends said adjust screw and that is larger than said through hole of said depressing block.

* * * * *